United States Patent [19]

Flider

[11] Patent Number: 4,941,588

[45] Date of Patent: Jul. 17, 1990

[54] OVERPACK DRUM

[75] Inventor: Frank S. Flider, Mattoon, Ill.

[73] Assignee: Justrite Manufacturing Company, Des Plaines, Ill.

[21] Appl. No.: 398,960

[22] Filed: Aug. 28, 1989

[51] Int. Cl.[5] ..... B65D 85/00

[52] U.S. Cl. ..... 220/302; 220/315

[58] Field of Search ..... 220/301, 302, 315, 318, 220/321

[56] References Cited

U.S. PATENT DOCUMENTS

| | | | |
|---|---|---|---|
| 1,927,029 | 9/1933 | Hammer | 220/302 |
| 2,313,881 | 3/1943 | Lewis | 220/302 |
| 2,883,083 | 4/1959 | Terry, Jr. et al. | 220/301 |
| 4,372,490 | 2/1983 | Le Caire, Jr. et al. | 220/302 |
| 4,428,496 | 1/1984 | Sardano | 220/302 |
| 4,497,419 | 2/1985 | Reitzel | 220/302 |
| 4,763,449 | 8/1988 | Vigneron et al. | 220/301 |

*Primary Examiner*—Joseph Man-Fu Moy

*Attorney, Agent, or Firm*—Irwin C. Alter

[57] ABSTRACT

A drum for containing hazardous waste wherein a plurality of cam locks are associated with the drum to retain the lid thereof in sealed position when locked and to release the lid in the cam locks' open position when access to the drum is desired, thereby obviating the need for threaded lids which are difficult to close as well as open, especially when they have been weathered.

7 Claims, 1 Drawing Sheet

OVERPACK DRUM

BACKGROUND OF THE INVENTION

The present invention relates to an overpack drum which is used to store drums that contain leaking corroded waste products that are environmentally hazardous materials.

While plastic salvage drums for use in containing hazardous materials and as an overpacking of other drums containing hazardous materials are known in the art, such drum containers have in the past included lids that are threaded on to the main body of the container. Such a construction is shown in U.S. Pat. No. 4,708,258, issued to Bondico as assignee and invented by Morris D. Shaw et al. While this drum has the necessary characteristics for overpacking other drums containing hazardous materials, it has been found that the use of the threaded lid has made it very difficult to assemble as well as remove the lids, especially where they have been weathered and have expanded and contracted.

The Bondico patent confirms that drum-type containers of the type used in overpacking must be corrosion-resistant, should combine mechanical strength with light weight and must be sufficiently strong in all points of construction so as to provide a container for the hazardous materials without leaking. Also, the containers must be able to withstand rough handling as well as transportation handling. In the United States, an overpack container must be approved by the United States Department of Transportation, which requires the containers to undergo rigorous testing. Dot requires having a container that can withstand being dropped and generally filled with water from a specified height onto a concrete slab. The angle at which the container is dropped into the concrete slab is varied. Accordingly, the overpack drums must be extremely strong and well constructed. The present invention attempts to incorporate all these characteristics while obviating having a threaded lid which works on the basis of cam latches.

SUMMARY AND OBJECTS OF THE INVENTION

It is therefore a primary object of this invention to fulfill the need of providing a polyethylene hazardous material overpack drum which exhibits great mechanical strength and resistance to leakage and satisfies all the requirements for containing hazardous material.

A further object of this invention is to provide a hazardous material overpack drum which eliminates threadedly associating the lid with the container and provides a lid which is both easy to tighten or loosen so that it can be removably and fixedly associated with the base of the container in a leak-tight manner such that a build-up of internal gas pressure will not violate the liquid tight seal between the drum and the lid.

Another object of the invention is to provide a molded polyethylene drum lid which not only has sufficient mechanical strength to meet handling requirements in a liquid free manner, but also, it has improved cam locks that eliminate threaded fastening of the lids.

In order to accomplish the aforementioned objectives according to the invention, a molded polyethylene overpack drum which has a container which can be removably associated with a series of cam locks in a leak tight manner with the lids.

With the foregoing and other objects and advantages and features of the invention, it will become hereinafter more readily apparent on reference to the following description of the invention, the claims and the views illustrated in the accompanying drawings wherein:

DESCRIPTION

Figure 1:
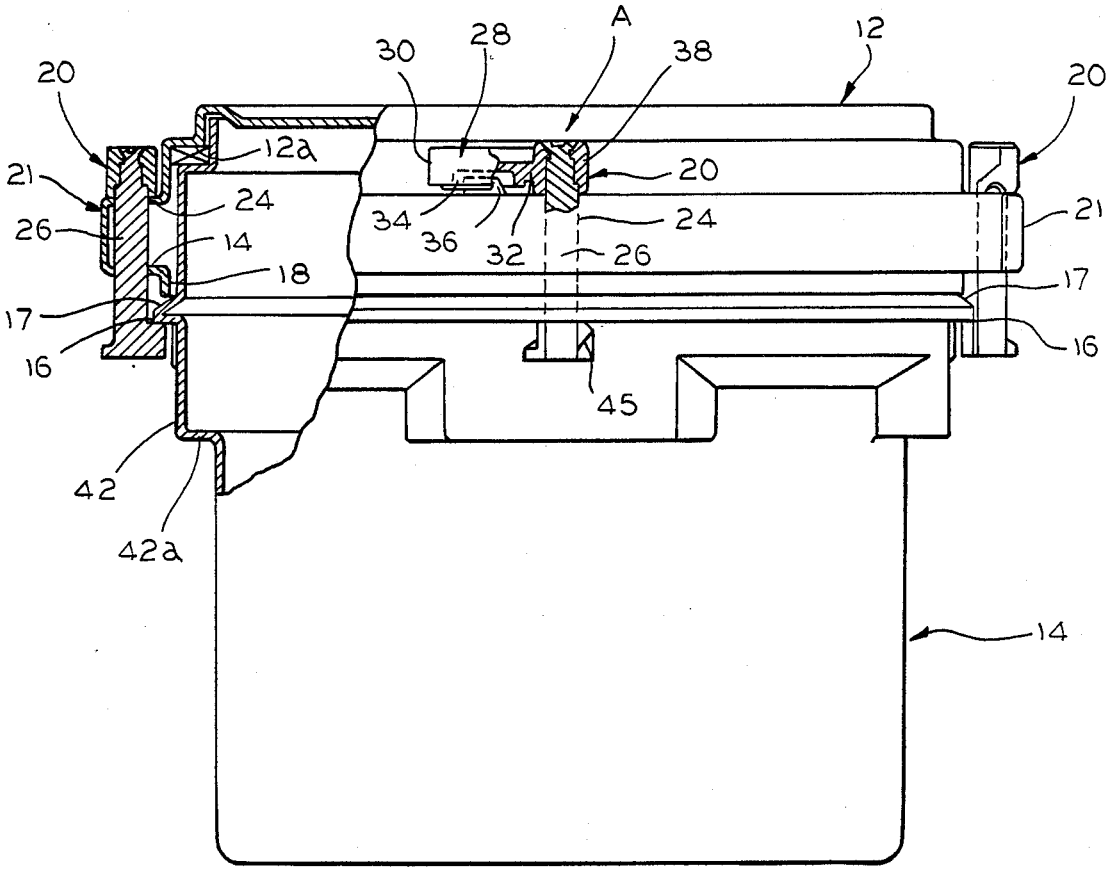
FIG. 1 is a side elevational view of the hazardous material overpack drum in accordance with the invention wherein the container and the lid of the drum are illustrated partially in section.

Referring now in detail to the drawings wherein like parts are designated by corresponding reference numerals throughout, the side elevational view of FIG. 1 illustrates an overpack drum 10 of circular cross section which includes a lid 12 and a container 14 of circular cross section made in accordance with this invention. The container 14 can be rotationally molded and has a circular lip 16 on the upper portion of the container and extending around the container circumferentially with a tapered incline portion 17 and a depending vertical circular portion 18 which facilitates the locking action of the cam locks 20 as will be described later. The lid 12 can be preferably, rotationally molded and it has a series of double wall bosses 21 formed thereon and depending therefrom in order that the cam locks 20 can be associated therewith. From the partial sectional view A of the cam lock and lid in FIG. 1, it can be seen that the cam latch bolts 26 of the cam locks 20 extend through the apertures 24 of the double walled bosses 21 and have their cam latch handles 28 shown in a locked position.

Depending from the double walled bosses is the vertical circular portion 18 that makes contact with the tapered incline portion 17 of the container 14.

The cam locks 20 are fixedly associated with the lid by fixedly associating the cam latch handles 28 therewith once the cam latch bolts 26 are extending through the apertures 24 of the double walled bosses 21. The cam latch handles 28 are adapted to receive the latch bolts by means of a keyed opening 38 and after the latch bolt is inserted through the double walled bosses 21 in contact with the lid so that they are associated with the cam latch handles 28 they can be heat stamped for permanent association. It should be noted that the upper portion of the cam latch bolts 26 has a square formed in it so that when the latch bolt handle 28 is associated therewith, it can act as a lever or crank to rotate the cam latch bolt 26.

Figure 2:
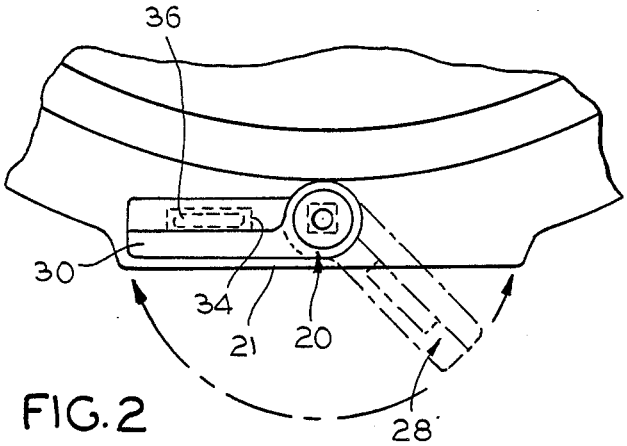
FIG. 2 is a top view showing a portion of the lid with a cam lock associated therewith.
Figure 3:
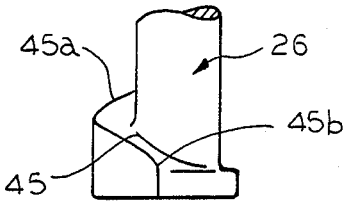
FIG. 3 is an enlarged view of a portion of the cam lock showing the inclined plane thereof of the latch bolt as will be more fully described below.

In FIG. 2, the latch bolt handle 28 is shown in both its open position and locked position. The cam latch bolt handle 28 is formed so that it has an upwardly extending grip portion 30 and a body portion 32 where a longitudinal slot portion 34 is formed so that when the cam latch handle is rotated it can be positioned in a fixed position and held there by upwardly protruding lugs 36 that extend from the lid and conform to the longitudinal slot portions 34 to retain the cam latch handles in a fixed position. This can be seen from FIGS. 1 and 2 where the region A shows a partial elevational and sectional of one of the cam locks 20 and handles in their locked position and FIG. 2 shows the top view of the handle in its locked position and open position as well in phantom.

As is seen from FIG. 1, the inclined portion 45 formed on the bottom of the cam latch bolt has an upper portion 45*a* that is positioned so that it exerts an upwardly normal force on the lower circular lip of the container thereby forcing the lid into locking contact by shortening the distance between the cam lever and the incline cam 45 so that the depending portion 18 of the lid is squeezed down on the tapered inclined portion 17 of the circular lip 16.

Thus, by having the circular gasket 40 in contact with a circular shoulder 12*a* of the upper portion of the lid 12, a sealing contact is obtained.

As seen from FIG. 2, when it is desired to release the pressure of the cam lock 20 so that it is no longer holding the lid, the cam latch handle 28 is gripped and rotated off of each one of the upwardly extending lugs 36 to a position which is shown in phantom in FIG. 2, where the upper portion of the incline surface 45*a* is no longer pressing on or squeezing the lid and the lip by means of the force of the cam lock's inclined plane upper portion 45*a*. When the cam latch handle 28 is rotated to its extreme open position, the lower inclined portion 45*b* is underneath the circular lip 16 and the inclined portion 45 is no longer in contact with the lower lip so that the lid 12 can be removed from the drum once all of the cam latch handles 28 are rotated to their open position.

Just as in U.S. Pat. No. 4,708,258, the container portions 14 are formed so that when they are unfilled they can be nested. This is accomplished by having the skirts 42 extending from the lids so that the shoulders 42*a* can be in contact with the upper portion of a container in which it is nested.

Thus, in operation, the container 14 is first filled by placing a drum containing hazardous materials into the overpack hazardous drum 10 when the lid is not associated therewith and the container portion lid 12 is not associated with the container portion 14. Then the lid 12 is placed on the container 14 whereupon each of the cam locks 20 that are associated with the lid are rotated to their closed position where their elongated slot portions 34 are in contact with the lugs extending from the lids and the lid is forced against the tapered incline portion 17 by means of the pressure being exerted by the upper portion of the incline portion 45 of the cam lock as seen from FIG. 1. In this position, the gasket 49 is compressed and pushed against the shoulder 12*a* of the lid 12 to form a leak-proof association of the lid with the container. Of course, as pressure builds up in the container, the internal pressure tightens the lid even further due to the additional pressure being exerted by the inclined portion 45. When it is desired to remove the material from the overpack drum, the cam latch handles 28 of the cam locks 20 are moved to their open positions to release the pressure on the lid and thereby allow the lid to be removed from the container.

The containers can be rotationally molded or blow molded. This structure has been preferably blow molded of polyethylene such as Petroleum Marlex No. 4903 or Soltex K44 high density polyethylene; both would have a UV additive. The nominal wall thickness of about 0.20 inches is preferred for both the lid and the container but any thickness that will meet the rigors of tough handling and moving can be used.

While only a preferred embodiment of the invention is specifically illustrated and described herein, it will be appreciated that many modifications and variations of the present invention are possible in light of the above teachings and within the purview of the appended claims without departing from the spirit and intended scope of the invention.

What is claimed is:

1. A salvage drum for containing hazardous materials comprising:

a lid having side walls with a circular bottom;

a container having a side wall that is circular in cross section, said side wall having a sealing means extending therefrom that is in contact with said lid's circular bottom when said lid is placed in its covering position on top of said container's side walls;

a plurality of cam locks located around the periphery of said lid, said cam locks having a locked and open position and being associated with said lid and each having a cam surface formed to lock the lid on the container in the closed position and release the lid from the container in its open position, said cam locks each having a latch bolt associated with each of said cam surfaces, said cam surfaces force said lid into locking contact with said container lid in said locked position and releasing pressure on said container lid in said open position, whereby said cam locks act to cause sufficient release and locking of said lid to said container.

2. In a salvage drum for hazardous waste materials as defined in claim 1, wherein said cam latch bolts are received by said lid by a plurality of double walled bosses with apertures formed on the periphery thereof;

whereby said latch bolts are received in parallel by said apertures of said double walled bosses and are positioned to move to the locked and open positions to either close or open the hazardous waste drum by rotating the inclined cam surface from the open position to the closed position.

3. A hazardous waste drum as defined in claim 2 wherein a cam latch handle is fixedly associated with each of said cam latch bolts and said latch bolts are received by the apertures in the bosses of said lid, said cam latch handles being fixedly held in perpendicular position to the top ends of said cam latch bolts, said handles having upwardly extending gripping portions and body portions that have slots formed therein, said body portions being forced into contact and maintained in closed position by said lid by means of lugs extending from said lid into said slots to preclude rotation of said handle and said cam bolts when said cam is in the closed position.

4. As defined in claim 3, wherein:

said handle can be rotated to release said lid and position said cams surface between the locked and open position by repositioning said cam handle so that said lug is not being retained in said slot.

5. As defined in claim 4, wherein a gasket is positioned between the lid and a shoulder portioned formed on the container portion to create a seal therebetween.

6. As defined in claim 5, wherein said inclined cam portion is formed on the lower end of each of said cam latch bolts and has a cam surface that is defined by an inclined plane that is formed around said bolts whereby said inclined plane being positionable from a closed position where it exerts its most force on said container lip to an open position where said lid is released by means of rotating said cam lock handle.

7. As in claim 6, wherein said cam latch bolt is formed with a geometrical key portion at its end and said handle having an aperture formed therein that conforms to the geometry of said keyed portion of said cam latch bolt, whereby said cam latch handle is fixedly associated with said cam latch bolt after receiving the key in said handle aperture when said cam latch bolt has been extended through said double bosses in the lid.

* * * * *